US006335497B1

(12) United States Patent
Perkins et al.

(10) Patent No.: US 6,335,497 B1
(45) Date of Patent: Jan. 1, 2002

(54) DE-ENERGIZED TAP CHANGER

(75) Inventors: Stephen A. Perkins; John B. Baskin; Edgar R. Eley, all of Jackson; Ralph S. Averitt, Bells; Juan L. Santana, Jackson; Marty C. Brasher, Jackson; Frank D. Wolfe, Jackson; John N. Powell, Jackson; James R. Scrivener, Jackson, all of TN (US)

(73) Assignee: ABB Power T&D Company Inc., Raleigh, NC (US)

( * ) Notice: Subject to any disclaimer, the term of this patent is extended or adjusted under 35 U.S.C. 154(b) by 0 days.

(21) Appl. No.: 09/496,476

(22) Filed: Feb. 2, 2000

(51) Int. Cl.[7] ..... H01H 15/06; H01H 9/00

(52) U.S. Cl. ..... 200/17 R; 200/1 R; 200/16 R

(58) Field of Search ..... 200/1 R, 1 V, 200/1 B, 11 R, 11 A, 11 TC, 16 R, 16 A, 16 C, 16 D, 16 E, 16 F, 17 R, 18, 38 R, 38 E, 33 D, 33 B, 50.32, 50.38, 547, 549, 550, 572, 500, 501, 275

(56) References Cited

U.S. PATENT DOCUMENTS 4,035,717 A 7/1977 Guidosh ..... 323/43.5 R
4,107,637 A 8/1978 Guidosh ..... 336/150
4,533,797 A * 8/1985 Kranich, II et al. .... 200/11 TC
4,562,316 A 12/1985 Kranich, II ..... 200/16 D
4,644,112 A * 2/1987 Kranich, II ..... 200/16 F
5,523,535 A * 6/1996 Larsson et al. ..... 200/11 TC
5,594,223 A * 1/1997 Fukushi et al. ..... 218/120
5,744,764 A 4/1998 Aschenbrenner et al. ... 200/1 R

OTHER PUBLICATIONS

Appareils Scientifiques De Precision, "Off–Circuit Tap Changers For Threephase Transformers in Oil or Askarel; Heavy Duty Tap Changers—Type FII Rack and Pinion or Cam Operated," published more than 1 year prior to application filing date, 5 pages.

* cited by examiner

*Primary Examiner*—Michael Friedhofer
(74) *Attorney, Agent, or Firm*—Woodcock Washburn Kurtz Mackiewicz & Norris LLP

(57) ABSTRACT

A de-energized tap changer is disclosed that includes a contact rail assembly, a gear assembly, a handle assembly and a transmission system that compensates for angular misalignment of the gear assembly and handle assembly. The transmission system includes two elongated members with attached blocks that fit inside a hollow tube and when the handle of the de-energized tap changer is rotated, torque is transmitted through the transmission system to the gear assembly which drives the movable contacts.

24 Claims, 7 Drawing Sheets

DE-ENERGIZED TAP CHANGER

FIELD OF THE INVENTION

This invention generally relates to de-energized tap changers used in power transformers. More particularly, the invention relates to a de-energized tap changer incorporating a self-aligning transmission system.

BACKGROUND OF THE INVENTION

Power transformers will typically utilize a de-energized tap changer, sometimes called a no-load tap changer, to make adjustments to the primary windings ratio. Such adjustments are necessary to compensate for long-term line voltage variations that depend on the physical distance of the transformer from the power source. This adjustment is initially made upon installation and further adjustments are usually only necessary a few more times over the life of the transformer based upon changes in the power system to which the transformer is connected.

Basically, a de-energized tap changer works by either increasing or decreasing the number of transformer windings utilized. Typically, the device will affect the number of windings on the primary side of the transformer, that is, the side of the transformer receiving power from the power source. Most de-energized tap changers are designed to operate around a five step switch. It is common practice to place the nominal system voltage as the middle step and split the remaining four steps into two groups of taps that will step up or step down the voltage usually by two and one-half percent for each step. This is the typical set-up as the American National Standards Institute recommends the utility supply a voltage that will not vary by more than five percent from the nominal system voltage.

A de-energized tap changer will typically include a series of fixed contacts, connected to the taps of the primary winding of the transformer, which are within the transformer tank and immersed in the transformer oil. A movable contact is driven between the contacts through a drive mechanism connected to a manually operated handle outside the tank of the transformer. Switching of tap positions is effected when there is no power being supplied to the transformer.

As mentioned, these changes are usually effected by a drive mechanism connected to a manually operated handle outside the tank of the transformer. The various positionings for each step, either up or down, will be marked on the outside of the tank such that the handle, and the contacts attached to it, can be properly aligned. As should be apparent, when the de-energized tap changer is installed it should be properly aligned such that with each position change of the handle on the outside of the tank, the proper corresponding positioning of the contacts is achieved on the interior of the tank. Thus, installation of a de-energized tap changer becomes a difficult task to undertake in light of having to align the contacts, as well as having to create a hole on the exterior of the tank whereby the handle of the de-energized tap changer may protrude. Currently, some de-energized tap changers utilize a universal joint to compensate for misalignment of the handle and the rest of the assembly. Such joints typically have a cross-shaped piece having pivots on its arms so arranged that each pair of pivots engage with the eyes of a yoke on the end of one shaft. While a universal joint may remedy some of the problems set forth above, they have a major drawback in that they can be very expensive. Therefore, a less complicated and less-expensive device is needed such that the degree of precision presently required upon installation may be lessened.

SUMMARY OF THE INVENTION

The tap changer of the present invention is designed to remedy the need for exact precision upon installing a de-energized tap changer and thus simplify the arduous task of installing the device. One presently preferred embodiment of the present invention achieves this goal by providing a de-energized tap changer which includes a contact rail assembly, a gear assembly, a handle assembly, and a transmission system which compensates for angular misalignment of the gear assembly and handle assembly. The transmission systems includes two elongated members which extend from the handle assembly and the gear assembly and are connected via an elongated hollow tube.

Other aspects of the present invention are described below.

BRIEF DESCRIPTION OF THE DRAWINGS

The above-mentioned and other features and advantages of the invention will be apparent to those of ordinary skill in the art from the following detailed description of which.

DETAILED DESCRIPTION OF THE PREFERRED EMBODIMENTS

Figure 1:
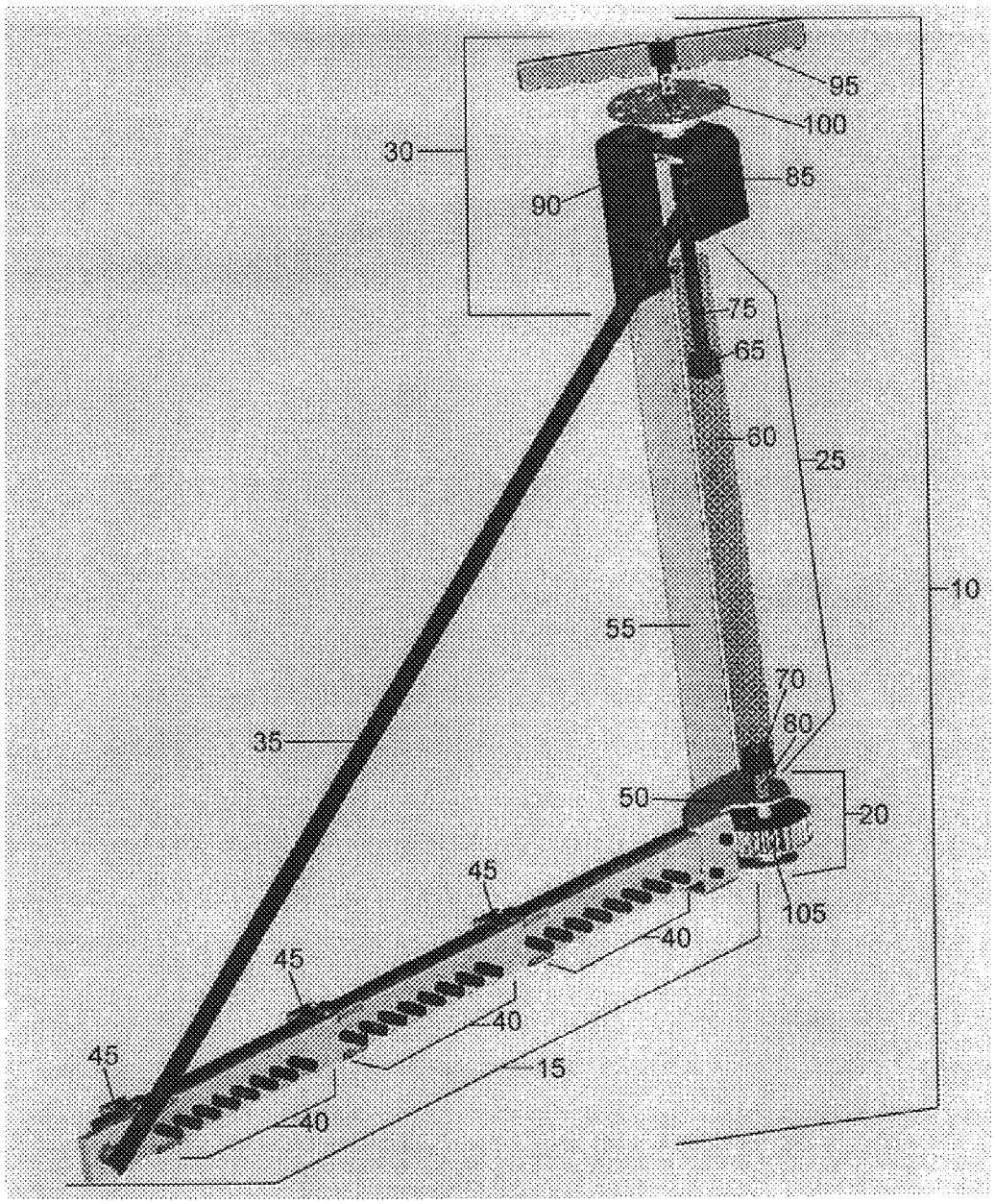
FIG. 1 depicts a presently preferred embodiment of a de-energized tap changer in accordance with the present invention. The elongated tube of the transmission system is illustrated as transparent to give an improved perspective of the other aspects of the transmission system.

The de-energized tap changer 10 illustrated in FIG. 1 includes a contact rail assembly 15, gear assembly 20, transmission system 25, handle assembly 30 and cantilever support 35. The contact rail assembly 15 includes a series of fixed contacts 40 as well as movable contacts 45 which can be driven between the fixed contacts 40 by the gear assembly 20. The gear assembly 20 is connected to the transmission system 25, which in turn is connected to the handle assembly 30.

The contact rail assembly 15 contains the fixed contacts. The rail can have any number of fixed contacts 40. The rail as shown, and the preferred embodiment, has twenty four contacts and some embodiments of the present invention may have more and some may have less.

The driving gear 105 is part of the gear assembly 20 and drives the rack which contains the movable contacts 45 that bridge across any of six of the fixed contacts 45 at any designated position. The gear bracket 50 secures the contact rail 15 and the driving gear 105 and is attached to the suspension bracket 55.

The transmission system 25 as shown in FIG. 1 is made up of a hollow tube 60 (shown transparent) and a first 65 and second 70 block attached to a first 75 and second 80 elongated member respectively. The first elongated member 75 is attached to the handle assembly 30 and the second elongated member 80 is attached to the gear assembly 20. The two blocks 65 and 70 engage the tube 60 and deliver torque to the gear 105 to move the movable contacts 45, while simultaneously allowing for angular misalignment of the first and second elongated members 75 and 80 extending from the handle assembly 30 and the gear assembly 20.

The handle assembly 30 includes a mounting boss 85 which is attached on the interior portion of the transformer tank (not shown). The mounting boss 85 is used to secure the entire switch to the transformer tank wall via a nut 90 which attaches to the bottom of the mounting boss 85. The entire tap changer 10, except for the hand assembly 30, can be pre-assembled before placement in the transformer tank, and the nut 90 can then secure the entire tap changer 10 to the tank. On the exterior of the tank, the handle 95 and indication plate 100 are then attached.

A cantilever support 35 is shown in FIG. 1. The cantilever support 35 is a diagonally positioned strip running from the mounting boss 85 to the end of the contact rail assembly 15 furthest away from the gear assembly 20. The preferred embodiment has a cantilever support 35 which is used to support the weight of the contact rail assembly 15.

Figure 2:
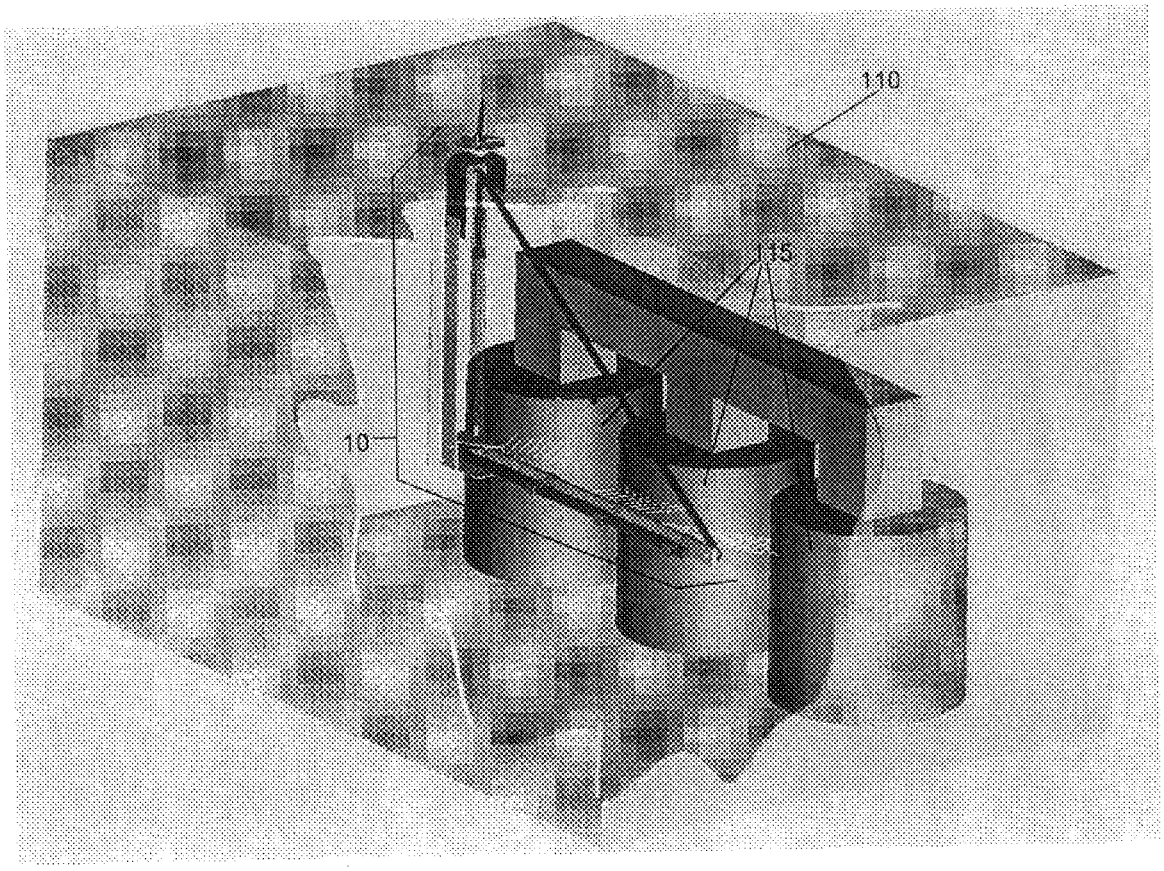
FIG. 2 depicts a cut-away view of a transformer tank with a de-energized tap changer installed on the top of a tank. Again, the elongated tube of the transmission system is illustrated as transparent.
Figure 3:
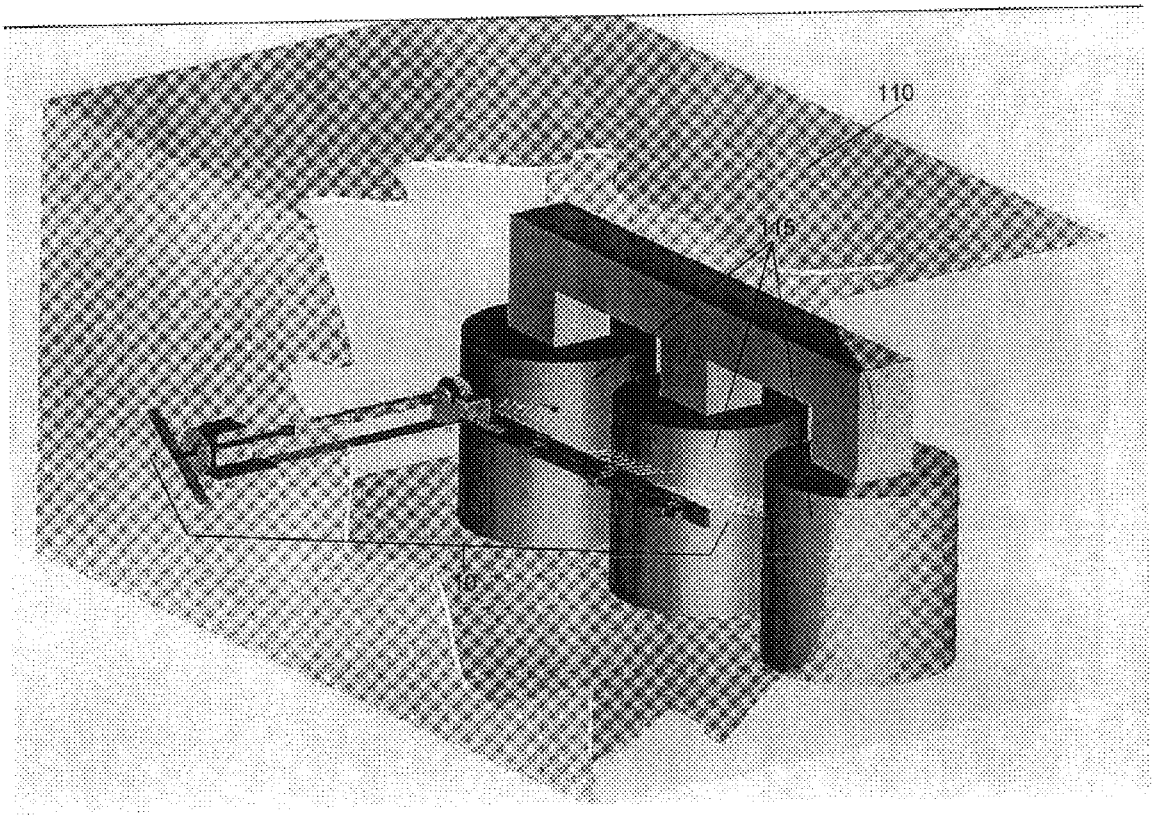
FIG. 3 depicts a cut away view of a transformer tank with a de-energized tap changer installed on the side of a tank. Again, the elongated tube of the transmission system is illustrated as transparent.

FIG. 2 illustrates a cut-away view of a transformer tank 110 with a de-energized tap changer 10 installed on the top of the tank 110. It is also possible with the present invention, as illustrated in FIG. 3, to install the de-energized tap changer 10 on the side of the transformer tank 110. FIGS. 2 and 3 illustrate the contact rail assembly 15 in connection with the taps of the primary winding 115 of the transformer inside the transformer tank 110. The contact rail assembly 15 will typically be immersed in transformer oil (not shown). The preferred embodiments of the present invention include the de-energized tap changer 10 set forth in this application incorporated into a transformer tank 110, as depicted in FIGS. 2 and 3.

Figure 4:
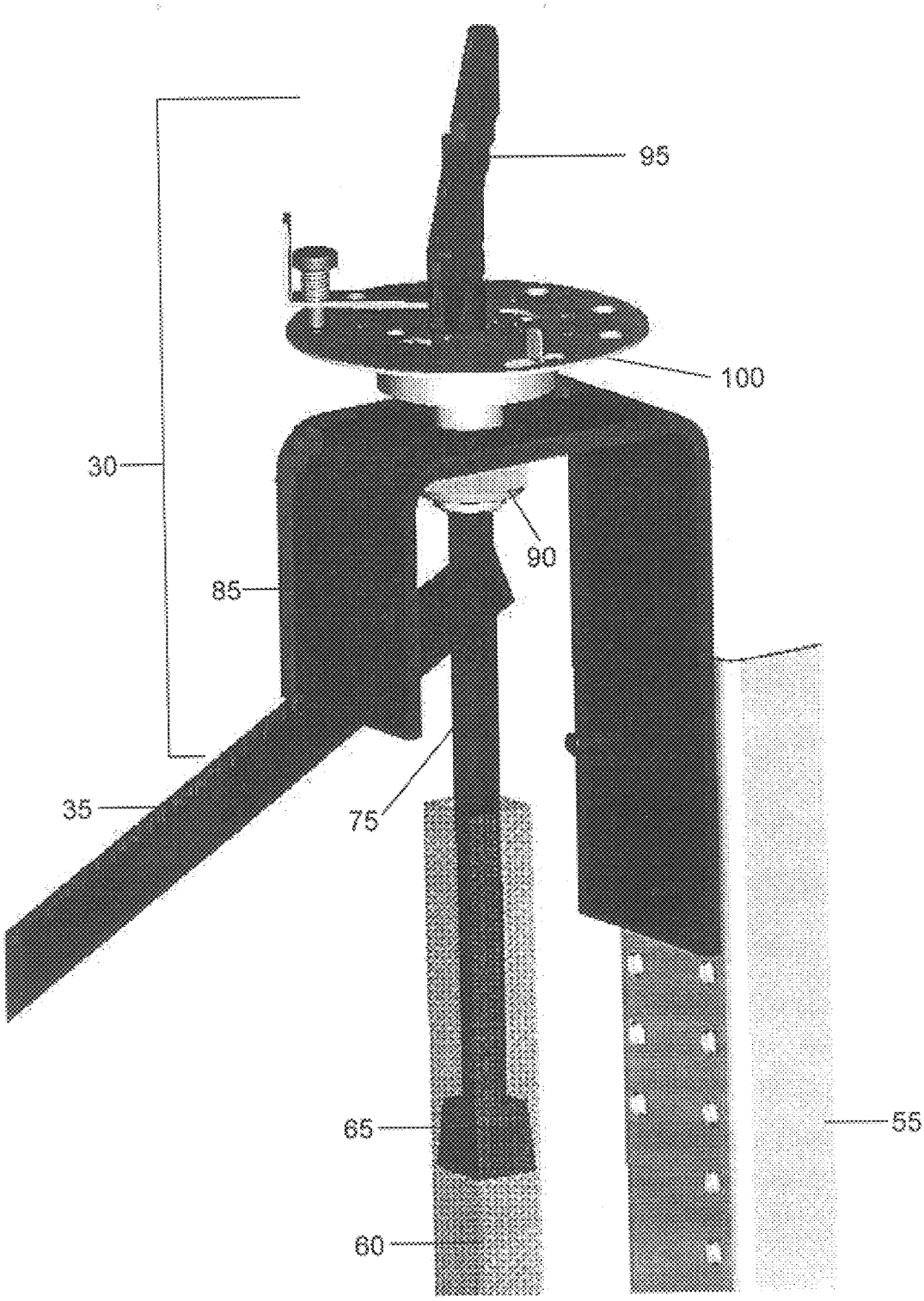
FIG. 4 illustrates the coupling system of the transmission system of the present invention whereby the handle assembly is attached to the elongated tube via the elongated member with the attached block. Again, the elongated tube of the transmission system is illustrated as transparent.

FIG. 4 illustrates the coupling system of the transmission system 25 whereby the handle assembly 30 is attached to the elongated tube 60 via the first elongated member 75 with the attached first block 65. The preferred embodiment of the first block 65 used in the present invention is a truncated square pyramid, that is, a pyramid with a square base and the upper portion of the pyramid removed such that a square face is formed that is parallel to the square base. Various blocks of other shapes may be used which, when attached to the elongated member, have either a proximal or distal face that is larger in area than the other. Other possible shapes include a pyramid and a pyramidal frustum where the base of such pyramid or frustum can be any polygon such as a rectangle, pentagon or hexagon. A frustum is the portion of a solid which lies between two parallel planes cutting the solid. Further embodiments of the present invention also include shapes similar to the frustum described but where the resulting planes are not parallel. The distal face described herein is the face of any of the blocks 65 and 70 which is furthest into the tube 60, i.e., the face of the block that is on the opposite end of the elongated member to which the block is attached. With reference to the preferred shapes mentioned, the base can either be the proximal face or the distal face, with the opposite face, or the tip in the case of the pyramid, being the other. The first block 65 described herein may be positioned with either the larger face as the distal face or the smaller face as the distal face, but the preferred embodiment of the present invention has the larger face further into the tube 60 and is thus the distal face. Thus, an important characteristic of the blocks 65 and 70 is that they have a shape that permits some misalignment of the tube 60 and either elongated member 75 or 80, while still transmitting torque from the handle 95 to the gear 105.

Figure 5:
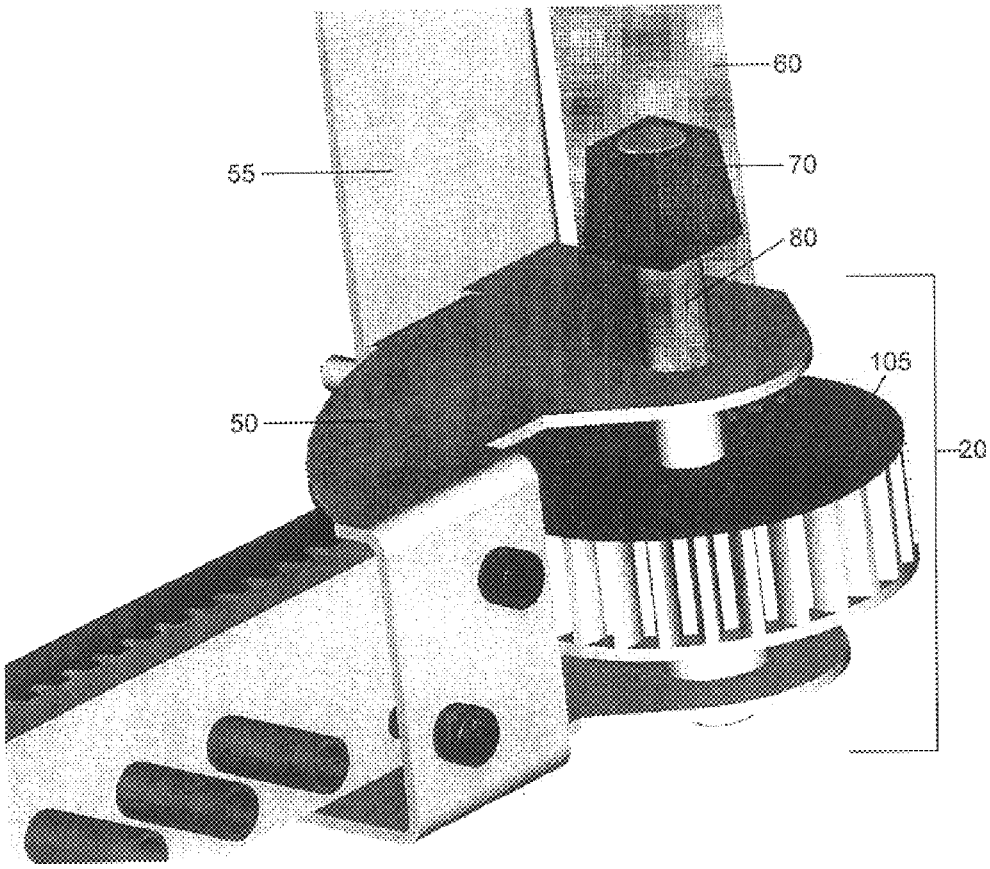
FIG. 5 illustrates the coupling system of the transmission system of the present invention whereby the gear assembly is attached to the elongated tube via the elongated member with the attached block. Again, the elongated tube of the transmission system is illustrated as transparent.

FIG. 5 illustrates the coupling system of the transmission system 25 whereby the gear assembly 20 is attached to the elongated tube 60 via the second elongated member 80 with the attached second block 70. As with the system described in FIG. 4, the preferred embodiment of the second block 70 used in the present invention is a truncated square pyramid, that is, a pyramid with a square base and the upper portion of the pyramid removed such that a square face is formed that is parallel to the square base. Various other shapes are possible for the blocks 65 and 70, including the examples set forth above. The second block 70 described herein may be positioned with either the larger face as the distal face or the smaller face as the distal face, but the preferred embodiment of the present invention has the larger face further into the tube 60 and is thus the distal face.

Figure 6:
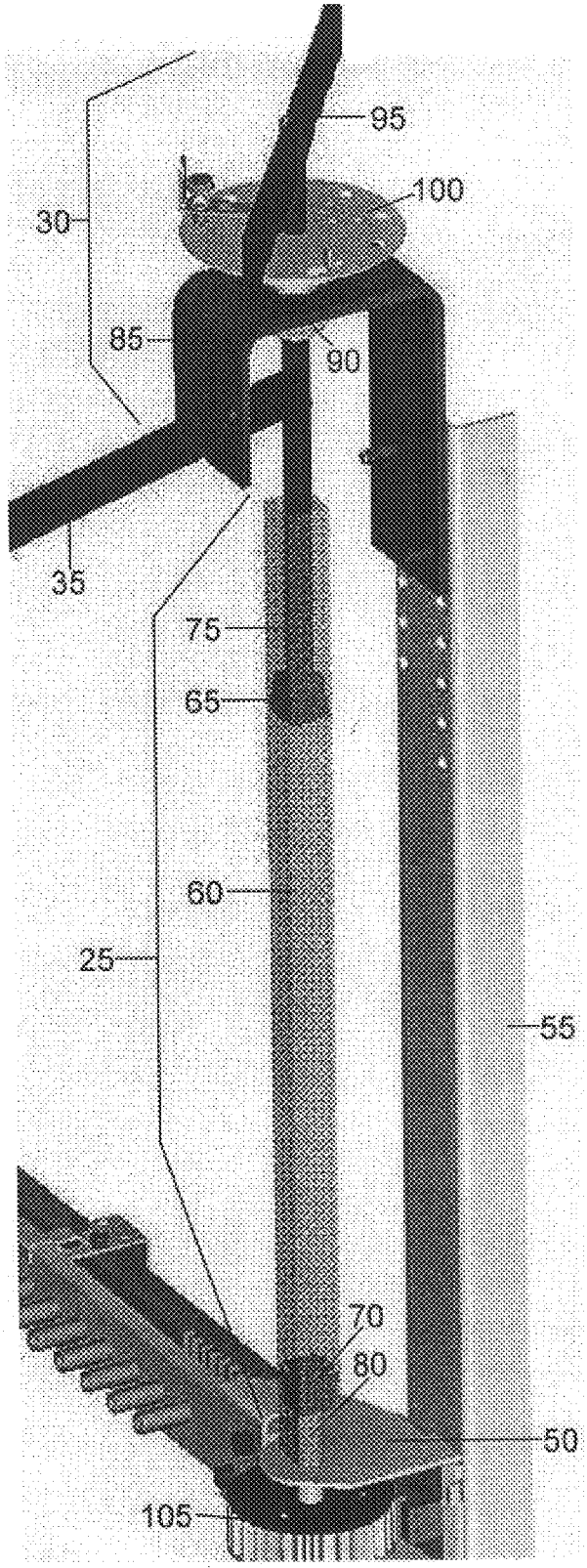
FIG. 6 illustrates the transmission system of the de-energized tap changer of the present invention. Again, the elongated tube of the transmission system is illustrated as transparent.
Figure 7:
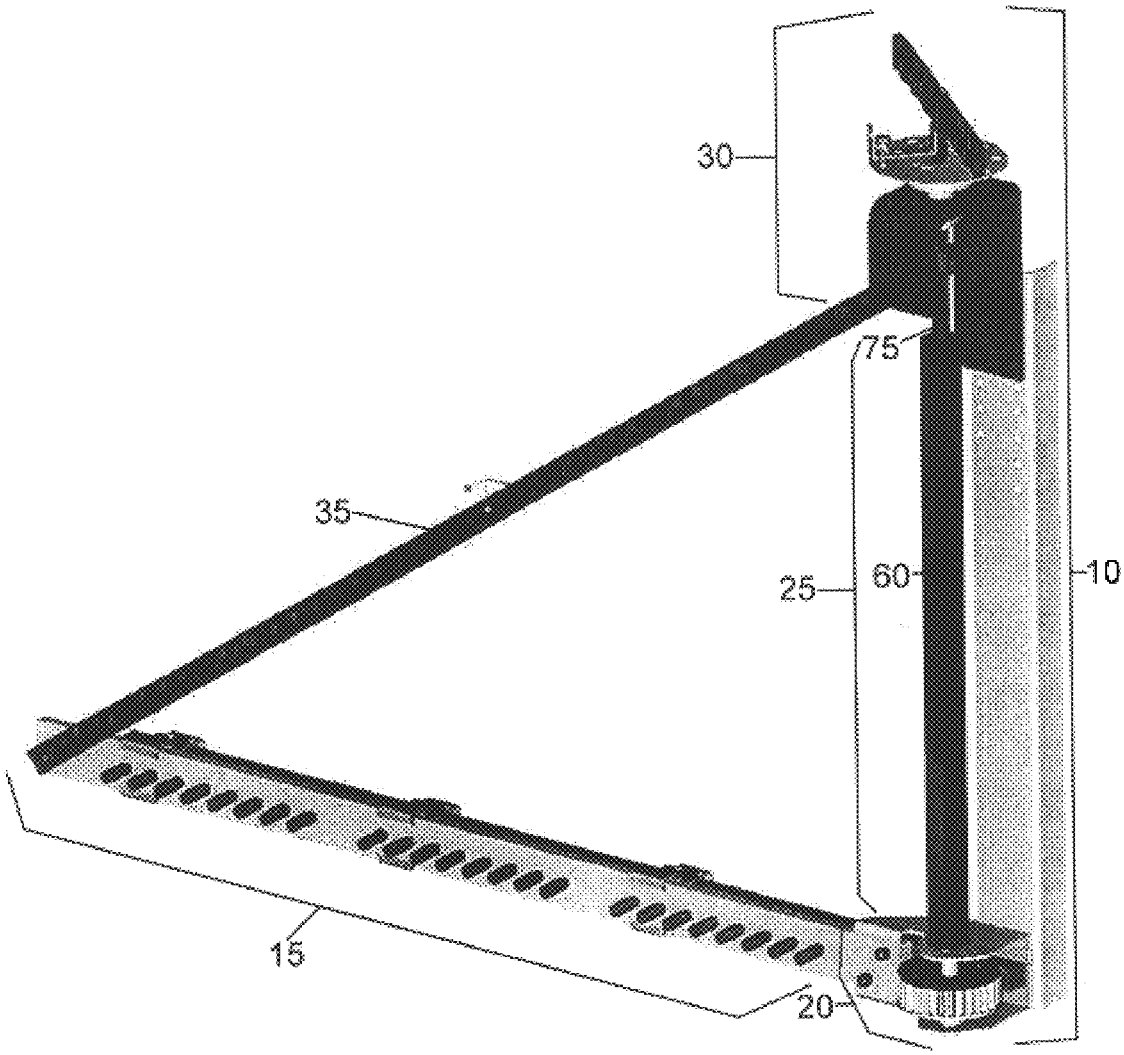
FIG. 7 illustrates the de-energized tap changer of the present invention. The elongated tube of the transmission systems is illustrated as solid in this figure, as it would be with the preferred embodiments of the present invention.

FIG. 6 illustrates a complete view of the transmission system 25 of the present invention. The preferred embodiment of the present invention includes a hollow elongated tube 60. It is further preferred that the hollow portion of the interior of the tube 60 have a shape similar to that of the larger of the proximal or distal faces of the first and second blocks 65 and 70 that are to be inserted into it. Preferably the larger of the proximal and distal faces of the first and second block 70 results in a snug fit when inserted into the hollow portion of the elongated tube 60. A snug fit-will result in a contact plane that includes the cross-section of the tube 60 and the plane of the larger of the proximal and distal faces of the blocks 65 and 70. A proper fit will result in proper operation of the de-energized tap changer 10 as discussed more fully below.

Transformer tanks can be constructed in a number of ways. Typically in a pad mounted transformer, the tank is mounted on a pad first and then the various other elements needed on the interior of the transformer are installed, including the de-energized tap changer. As previously mentioned, when installing the de-energized tap changer it is necessary to drill a hole either in the top or the side of the tank for the transmission system on the interior of the tank to connect to the handle on the exterior of the tank. In the prior art, the handle assembly then must be in proper alignment with the transmission system, which in turn must be in proper alignment with the gear assembly which has to drive the movable contacts which also have to be properly positioned. As should be evident in the prior art, installation becomes a difficult task.

A preferred embodiment of the present invention includes the de-energized tap changer 10 set forth above where the first and second elongated members 75 and 80, attached to the first block 65 and second block 70 respectively, can be of various lengths. An elongated member which has an extended length obviates the need for exact precision on the length of the de-energized tap changer 10 from the handle assembly 30 to the gear assembly 20. In other words, the de-energized tap changer 10 can be installed as one unit, and the contact rail and handle assemblies 15 and 30 can be properly positioned because the elongated member which will have room to move vertically (assuming the tap changer is top-mounted) inside the elongated tube 60. The preferred embodiment of the present invention will have approximately five inches of vertical adjustment. Thus, the same de-energized tap changer 10 gives the installer a transmission system 25 of variable length and therefore eases the installation process.

The vertical movement in the hollow tube 60 remedies the problem of distance from the handle assembly 30 to the gear assembly 20, but the problem of angular misalignment between those two assemblies also exists. The preferred embodiments of the present invention also allow for such angular misalignment between the handle assembly 30 and the gear assembly 20 upon installation. In other words, the handle assembly 30 and the gear assembly 20, as well as the distal faces of the first and second blocks 65 and 70, do not have to run on parallel planes with respect to each other. Instead, the angled sides of the blocks 65 and 70, which result from unequal proximal and distal faces, allow the tube 60 to pivot in various directions and upon installation, can allow for the tube 60 to connect the first and second blocks 65 and 70 which may be somewhat misaligned. With the transmission system 25 then connecting the handle assembly 30 and the gear assembly 20 and installed in the de-energized tap changer 10, rotational synchronization can be maintained among the entire transmission system 25, as well as the handle assembly 30 and gear assembly 20 to which it is attached. Thus, the preferred embodiment of the de-energized tap changer 10 of the present invention will function by rotating the handle assembly 30 which transmits torque through the transmission system 25 to the gear assembly 20, which in turn drives the gear wheel 105 which changes the position of the movable contacts 45 on the rail assembly 15. With rotational synchronization maintained throughout the transmission system 25, any misalignment of the handle assembly 30 or the gear assembly 20 will not present a serious difficulty as the elongated tube 60 can pivot along the first and second block 65 and 70 and render the whole apparatus functional.

A preferred embodiment of the present invention also includes a transformer tank 110 as illustrated in FIGS. 2 and 3. The preferred embodiments will contain a core, a primary winding, a secondary winding, a circuit power interrupter, and a de-energized tap changer 10. Further preferred is a transformer tank 110 utilizing the de-energized tap changer 10, and the preferred embodiments, as set out above.

The scope of protection of the following claims is not intended to be limited to the presently preferred embodiments disclosed herein. Those skilled in the art will readily appreciate that many modifications can be made to the preferred embodiments described herein.

What is claimed is:

1. A de-energized tap changer, said de-energized tap changer being mountable in a tank and comprising:

a contact rail assembly;

a gear assembly coupled to said contact rail assembly;

a handle assembly; and a transmission system which is coupled to said gear assembly and said handle assembly and compensates for angular misalignment of said gear assembly and said handle assembly, wherein said transmission system comprises:

a first elongated member attached to a first block and extending from said handle assembly;

a second elongated member attached to a second block and extending from said gear assembly; and a hollow elongated tube whereby said first block and said second block fit entirely inside a hollow portion of said tube.

2. The de-energized tap changer of claim 1 wherein distal faces and proximal faces of said first block and said second block have unequal surface areas.

3. The de-energized tap changer of claim 2 wherein the larger of said distal face and said proximal face of said first block and said second block are polygons.

4. The de-energized tap changer of claim 3 wherein the larger of said distal face and said proximal face of said first block and said second block are squares.

5. The de-energized tap changer of claim 4 wherein said distal faces of said first block and said second block have larger surface areas than said proximal faces of said first block and said second block.

6. The de-energized tap changer of any of claims 2–5 wherein the larger of said distal face and said proximal face of said first block and said second block have a shape that matches an inside shape of the hollow elongated tube, whereby the first and second blocks engage the hollow elongated tube and thereby transmit torque from the handle assembly to the gear assembly upon rotation of the handle assembly.

7. A de-energized tap changer, said de-energized tap changer being mountable in a tank and comprising:

a contact rail assembly;

a gear assembly coupled to said contact rail assembly;

a handle assembly; and a transmission system which is coupled to said gear assembly and said handle assembly and compensates for varying distances between said gear assembly and said handle assembly wherein said transmission system comprises:

a first elongated member attached to a first block and extending from said handle assembly;

a second elongated member attached to a second block and extending from said gear assembly; and a hollow elongated tube whereby said first block and said second block fit entirely inside a hollow portion of said tube.

8. The de-energized tap changer of claim 7 wherein distal faces and proximal faces of said first block and said second block have unequal surface areas.

9. The de-energized tap changer of claim 8 wherein the larger of said distal face and said proximal face of said first block and said second block are polygons.

10. The de-energized tap changer of claim 9 wherein the larger of said distal face and said proximal face of said first block and said second block are squares.

11. The de-energized tap changer of claim 10 wherein said distal faces of said first block and said second block have larger surface areas than said proximal faces of said first block and said second block.

12. The de-energized tap changer of any of claims 8–11 wherein the larger of said distal face and said proximal face of said first block and said second block have a shape that matches an inside shape of the hollow elongated tube, whereby the first and second blocks engage the hollow elongated tube and thereby transmit torque from the handle assembly to the gear assembly upon rotation of the handle assembly.

13. A de-energized tap changer, said de-energized tap changer being mountable in a tank and comprising:

a contact rail assembly;

a gear assembly coupled to said contact rail assembly;

a handle assembly; and a transmission system which is coupled to said gear assembly and said handle assembly and compensates for angular misalignment of said gear assembly and said handle assembly, wherein said transmission system comprises:

a first elongated member attached to a first block and extending from said handle assembly;

a second elongated member attached to a second block and extending from said gear assembly; and a hollow elongated tube whereby said first block and said second block may fit inside a hollow portion of said tube such that said first block and said second block do not extend transversely through said tube.

14. The de-energized tap changer of claim 13 wherein distal faces and proximal faces of said first block and said second block have unequal surface areas.

15. The de-energized tap changer of claim 14 wherein the larger of said distal face and said proximal face of said first block and said second block are polygons.

16. The de-energized tap changer of claim 15 wherein the larger of said distal face and said proximal face of said first block and said second block are squares.

17. The de-energized tap changer of claim 16 wherein said distal faces of said first block and said second block have larger surface areas than said proximal faces of said first block and said second block.

18. The de-energized tap changer of any of claims 14–17 wherein the larger of said distal face and said proximal face of said first block and said second block have a shape that matches an inside shape of the hollow elongated tube, whereby the first and second blocks engage the hollow elongated tube and thereby transmit torque from the handle assembly to the gear assembly upon rotation of the handle assembly.

19. A de-energized tap changer, said de-energized tap changer being mountable in a tank and comprising:

a contact rail assembly;

a gear assembly coupled to said contact rail assembly;

a handle assembly; and a transmission system which is coupled to said gear assembly and said handle assembly and compensates for varying distances between said gear assembly and said handle assembly wherein said transmission system comprises:

a first elongated member attached to a first block and extending from said handle assembly;

a second elongated member attached to a second block and extending from said gear assembly; and a hollow elongated tube whereby said first block and said second block may fit inside a hollow portion of said tube such that said first block and said second block do not extend transversely through said tube.

20. The de-energized tap changer of claim 19 wherein distal faces and proximal faces of said first block and said second block have unequal surface areas.

21. The de-energized tap changer of claim 20 wherein the larger of said distal face and said proximal face of said first block and said second block are polygons.

22. The de-energized tap changer of claim 21 wherein the larger of said distal face and said proximal face of said first block and said second block are squares.

23. The de-energized tap changer of claim 22 wherein said distal faces of said first block and said second block have larger surface areas than said proximal faces of said first block and said second block.

24. The de-energized tap changer of any of claims 20–23 wherein the larger of said distal face and said proximal face of said first block and said second block have a shape that matches an inside shape of the hollow elongated tube, whereby the first and second blocks engage the hollow elongated tube and thereby transmit torque from the handle assembly to the gear assembly upon rotation of the handle assembly.

* * * * *